US010417947B2

(12) United States Patent
Mosier et al.

(10) Patent No.: US 10,417,947 B2
(45) Date of Patent: Sep. 17, 2019

(54) FAIL-OPERATIONAL EMISSIVE DISPLAY WITH REDUNDANT DRIVE ELEMENTS

(71) Applicant: Rockwell Collins, Inc., Cedar Rapids, IA (US)

(72) Inventors: Donald E. Mosier, Cedar Rapids, IA (US); Tracy J. Barnidge, Marion, IA (US); Jon J. Freesmeier, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 104 days.

(21) Appl. No.: 14/755,062

(22) Filed: Jun. 30, 2015

(65) Prior Publication Data

US 2017/0004763 A1 Jan. 5, 2017

(51) Int. Cl.
*G09G 3/20* (2006.01)

(52) U.S. Cl.
CPC ..... *G09G 3/20* (2013.01); *G09G 2330/08* (2013.01)

(58) Field of Classification Search
CPC ..... G09G 3/3208
See application file for complete search history.

(56) References Cited

U.S. PATENT DOCUMENTS 4,368,523 A * 1/1983 Kawate ..... G02F 1/13624 257/E27.084
4,676,761 A * 6/1987 Poujois ..... G01R 31/2853 324/537
4,820,222 A * 4/1989 Holmberg ..... G01R 31/2621 324/760.01
4,834,505 A * 5/1989 Migliorato ..... G02F 1/133514 349/106
4,922,240 A * 5/1990 Duwaer ..... G02F 1/1345 345/100
5,402,149 A * 3/1995 Amagami ..... G09G 3/20 345/100
5,555,001 A * 9/1996 Lee ..... G09G 3/3688 327/526
5,621,555 A * 4/1997 Park ..... G02F 1/13624 349/147
5,784,042 A * 7/1998 Ono ..... G09G 3/3648 345/208
5,926,156 A * 7/1999 Katoh ..... G09G 3/3677 345/100
6,191,770 B1 * 2/2001 Kim ..... G09G 3/006 324/754.03
6,285,360 B1 * 9/2001 Li ..... G09G 3/20 345/204

(Continued)

FOREIGN PATENT DOCUMENTS

JP 2009003009 A * 1/2009

*Primary Examiner* — Nitin Patel
*Assistant Examiner* — Robert M Stone
(74) *Attorney, Agent, or Firm* — Angel N. Gerdzhikov; Donna P. Suchy; Daniel M. Barbieri

(57) ABSTRACT

Fail-operational display devices and methods for controlling such fail-operational display devices are disclosed. More specifically, emissive displays having independently addressable (controllable) light emitting elements fitted with redundant control circuits may be utilized. In the event of a failure, one set of redundant control circuits may be disabled while another set of redundant control circuits may be enabled to keep the display device fail-operational.

8 Claims, 3 Drawing Sheets

(56) References Cited

U.S. PATENT DOCUMENTS

| | | | | |
|---|---|---|---|---|
| 6,467,057 | B1 * | 10/2002 | Wang | G09G 3/3677 714/726 |
| 7,295,179 | B2 | 11/2007 | Dunn | |
| 2001/0022647 | A1 * | 9/2001 | Kim | G02F 1/1309 349/187 |
| 2003/0169247 | A1 * | 9/2003 | Kawabe | G09G 3/342 345/204 |
| 2004/0130520 | A1 * | 7/2004 | Maeda | G09G 3/20 345/100 |
| 2005/0041002 | A1 * | 2/2005 | Takahara | G09G 3/3241 345/76 |
| 2005/0162737 | A1 * | 7/2005 | Whitehead | G02F 1/01 359/454 |
| 2008/0111771 | A1 * | 5/2008 | Miller | G09G 3/30 345/76 |
| 2008/0136348 | A1 * | 6/2008 | Varrin | G09F 9/33 315/291 |
| 2008/0284760 | A1 * | 11/2008 | Brunner | G09G 3/006 345/204 |
| 2013/0106832 | A1 * | 5/2013 | Meeker | G01C 21/3638 345/419 |
| 2013/0176318 | A1 * | 7/2013 | Dunn | G09G 3/36 345/501 |
| 2014/0139499 | A1 * | 5/2014 | Hussain | H05B 33/0827 345/204 |
| 2015/0373289 | A1 * | 12/2015 | Choi | H04N 5/378 348/272 |
| 2016/0358533 | A1 * | 12/2016 | Rotzoll | G09G 3/32 |
| 2017/0025075 | A1 * | 1/2017 | Cok | G09G 3/32 |

* cited by examiner

FAIL-OPERATIONAL EMISSIVE DISPLAY WITH REDUNDANT DRIVE ELEMENTS

BACKGROUND

Display systems may broadly include emissive displays and non-emissive displays. An emissive display refers to a display capable of producing an image directly without requiring a backlight. Research in field emission displays, for example, provide various exemplary types of emissive displays. Other types of displays, such as light-emitting diode (LED) displays, organic light-emitting diode (OLED) displays, surface-conduction electron-emitter displays (SEDs) and the like, may also be generally referred to as emissive displays. A non-emissive display, on the other hand, refers to a display that requires a light source. Light modulating display devices, such as liquid crystal displays (LCDs), for example, are non-emissive displays.

A "fail-operational" system refers to a system that can continue to operate even after a failure has occurred. Operation after failure is required for many aircraft systems, including display systems for delivering critical primary flight information. A conventional implementation of an aircraft display system typically includes multiple displays horizontally positioned across an instrument panel. These displays are secured to fixed locations and cannot be repositioned. Some of the adjacent displays may have abilities to enter a reversionary mode and serve as a backup to a primary display in case of a primary display failure. The ability for an adjacent display to enter a reversionary mode may allow a pilot to maintain aircraft control and proceed in a degraded state.

It is noted, however, that the location of the adjacent display (now serving as a backup to the primary display) is sub-optimal compared to the location of the primary display. Using a backup display located at a sub-optimal location has several disadvantages. For instance, relocation of the primary flight information on the instrument panel may impact pilot's cross-check habit patterns and may result in extended visual search during periods of high workload. The pilot may also be required to perform additional actions in order to view detailed system information due to the display being used in the reversionary mode. In addition, the need for having to equip an instrument panel with multiple displays (so that adjacent displays can serve as backups) may contribute to added weight and excessive instrument panel clutter. Furthermore, a display that may serve as a backup display needs to be configured in a manner that can maintain readability across an extended field of view, resulting in the need for additional power or added unit cost.

It is also noted that recent development in flight deck designs are increasingly dependent on single large displays. There may not be an adjacent display available that is capable of serving as a backup to a single large display, and it may therefore be essential to design such a single large display to be fail-operational.

SUMMARY

In one aspect, embodiments of the inventive concepts disclosed herein are directed to a display device. The display device may include: at least one set of light-emitting elements; at least two redundant sets of control circuits configured to control the at least one set of light-emitting elements; and a controller in communication with the at least two redundant sets of control circuits. The controller may be configured to: disable a first set of the at least two redundant sets of control circuits from controlling the at least one set of light-emitting elements; and enable a second set of the at least two redundant sets of control circuits to control the at least one set of light-emitting elements.

In a further aspect, embodiments of the inventive concepts disclosed herein are directed to a display device. The display device may include at least two sets of light-emitting elements jointly forming a display panel, the at least two sets of light-emitting elements including a first set of light-emitting elements and a second set of light-emitting elements, wherein the first set of light-emitting elements and the second set of light-emitting elements are interleaved across the display panel. The display device may also include a set of control circuits dedicated for each particular set of the at least two sets of light-emitting elements, wherein the set of control circuits dedicated for each particular set of light-emitting elements is configured to provide controls specific to that particular set of light-emitting elements.

In another aspect, embodiments of the inventive concepts disclosed herein are directed to a display device. The display device may include a first set of light-emitting elements and a second set of light-emitting elements jointly forming a display panel, wherein the first set of light-emitting elements and the second set of light-emitting elements are interleaved across the display panel. The display device may also include a first set of control circuits dedicated to control the first set of light-emitting elements and a second set of control circuits dedicated to control the second set of light-emitting elements. The display device may further include a controller in communication with the first and second sets of control circuits. The controller may be configured to selectively enable or disable at least one of the first and the second sets of control circuits.

It is to be understood that both the foregoing general description and the following detailed description are exemplary and explanatory only and are not restrictive of the inventive concepts disclosed and claimed herein. The accompanying drawings, which are incorporated in and constitute a part of the specification, illustrate embodiments of the inventive concepts and together with the general description, serve to explain the principles and features of the inventive concepts disclosed herein.

BRIEF DESCRIPTION OF THE DRAWINGS

The numerous objects and advantages of the inventive concepts disclosed herein may be better understood by those skilled in the art by reference to the accompanying figures in which.

DETAILED DESCRIPTION

Reference will now be made in detail to exemplary embodiments of the inventive concepts disclosed herein, examples of which are illustrated in the accompanying drawings.

Embodiments in accordance with the inventive concepts disclosed herein are directed to fail-operational display systems and methods for controlling such fail-operational display systems. More specifically, emissive displays having independently addressable (controllable) light emitting elements fitted with redundant control circuits may be utilized as fail-operational display systems.

Figure 1:
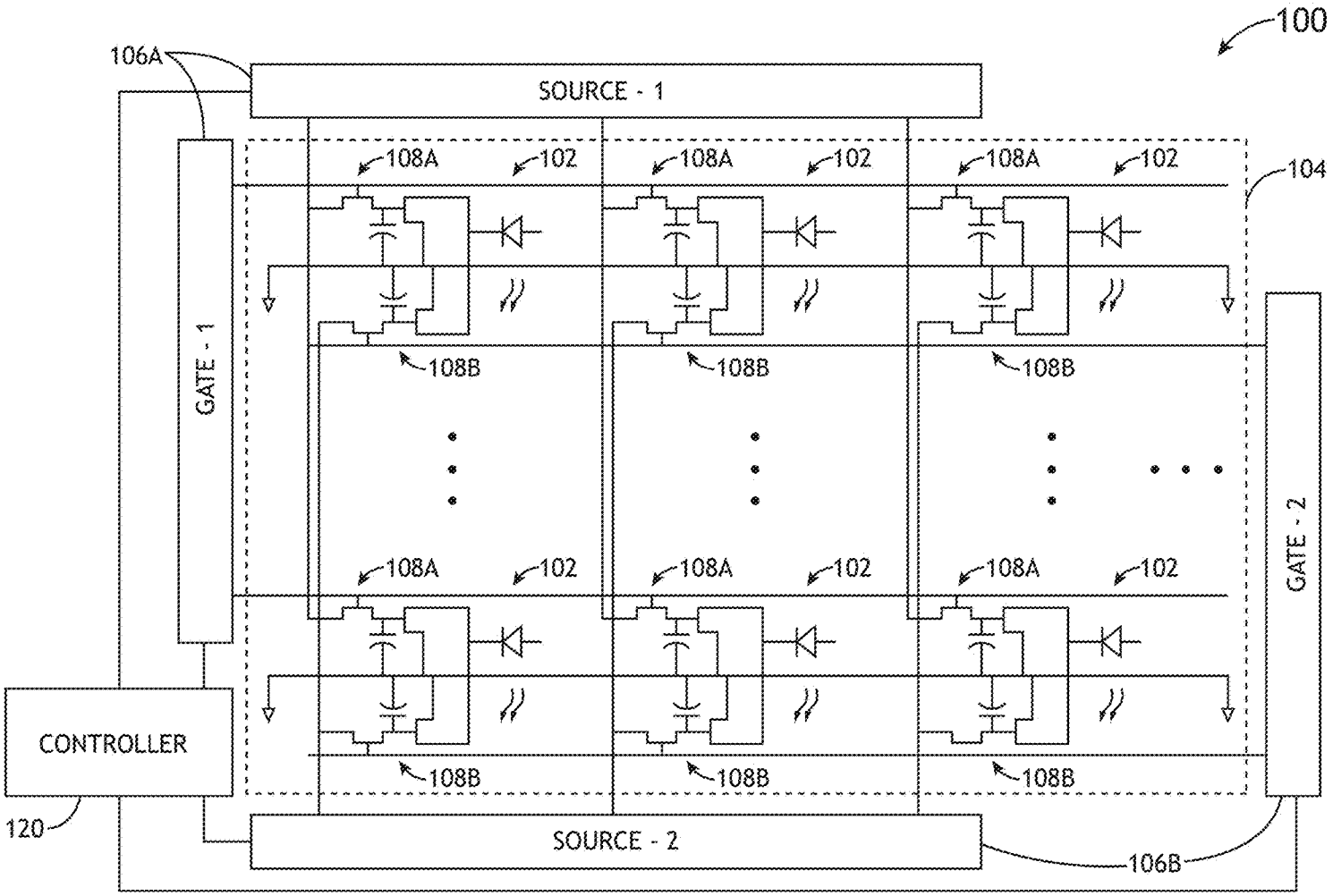
FIG. 1 is a simplified circuit diagram depicting a display device according to an exemplary embodiment of the inventive concepts disclosed herein.

Referring to FIG. 1, a simplified circuit diagram depicting an exemplary display device 100 is shown. It is noted that while symbols that are typically associated with LEDs are used in this circuit diagram (and subsequent diagrams), these symbols are meant to represent generic light-emitting elements 102, and are not meant to be limited to LEDs. It is to be understood that other types of light-emitting elements 102 (e.g., LEDs, OLEDs, SEDs, as well as other types of emitters) may be utilized without departing from the broad scope of the inventive concepts disclosed herein.

As shown in FIG. 1, the display device 100 may include a set of light-emitting elements 102 that forms a display panel 104. The display device 100 may also include two sets of redundant source and gate control line drivers 106A and 106B configured to drive two sets of drive circuits 108A and 108B. It is noted that since various implementations of source and gate control lines and drive circuits are known in the art, they are depicted schematically in the illustration for simplicity. It is also noted that the source and gate control lines and their corresponding drive circuits may be jointly referred to as "control circuits" for the light-emitting elements in the present disclosure.

It is further noted that both drive circuits 108A and 108B may be utilized to address the same set of light-emitting elements 102. The drive circuits 108A and 108B may be interleaved (or interlaced) with respect to rows and/or columns of the light-emitting elements 102. As will be described in more details below, the drive circuits 108A and 108B interleaved in this manner may reduce the perceived impact of a failure, and even the worst case failure condition (e.g., if one of the drive circuits 108A or 108B fails completely) may be fully recovered, allowing the display device 100 to maintain its operations over the entire display panel 104 even under such failure conditions.

For instance, in certain implementations, one set of control circuits (e.g., the drive circuits 108A and the source and gate control line driver 106A) may be utilized to drive the light-emitting elements 102 while the other set of control circuits (e.g., the drive circuits 108B and the source and gate control line driver 106B) may remain inactive or unpowered. Following a detected failure in the drive circuits 108A and/or the source and gate control line driver 106A, the drive circuits 108A and the source and gate control line driver 106A may be disabled/inactivated and the drive circuits 108B and the source and gate control line driver 106B may be enabled/activated to take over the control of the light-emitting elements 102. The redundancy provided in this manner allows the display device 100 to remain fully operational even when one of the drive circuits 108A/108B and/or one of the source and gate control line drivers 106A/106B fail partially or completely.

It is contemplated that various techniques may be utilized to detect the failures that may occur. For instance, failure detection may be performed utilizing an external electrical monitoring circuitry that monitors the health of the drive circuits 108A and 108B as well as the source and gate control line drivers 106A and 106B. Alternatively and/or additionally, one or more optical/image sensors may be utilized to observe whether a failure has occurred based on optical observations of the display device 100. The user may also be provided with an option to manually specify a user-observed failure. Once a failure is detected, the failure may be reported to a controller 120 that is in communication with the source and gate control line drivers 106A and 106B, and the controller 120 may conditionally disable/enable one of the source and gate control line drivers 106A or 106B and their corresponding drive circuits 108A or 108B as described above.

Alternatively and/or additionally, the controller 120 may periodically switch between the two sets of control circuits 106A/108A and 106B/108B according to a predetermined schedule, allowing them to take turns to actively control the light-emitting elements 102. It is noted that periodically switching between the two sets of control circuits 106A/108A and 106B/108B may help reduce operational fatigue and improve reliability and life of both sets.

It is contemplated that the controller 120 may include one or more processors, which may be coupled with non-transitory processor readable media storing processor-executable code configured to cause the processor to carry out its intended functions. It is to be understood that the controller 120 may be implemented as integrated circuits, dedicated processing units, field-programmable gate arrays, or various other types of processors or processing units without departing from the broad scope of the inventive concepts disclosed herein.

Figure 2:
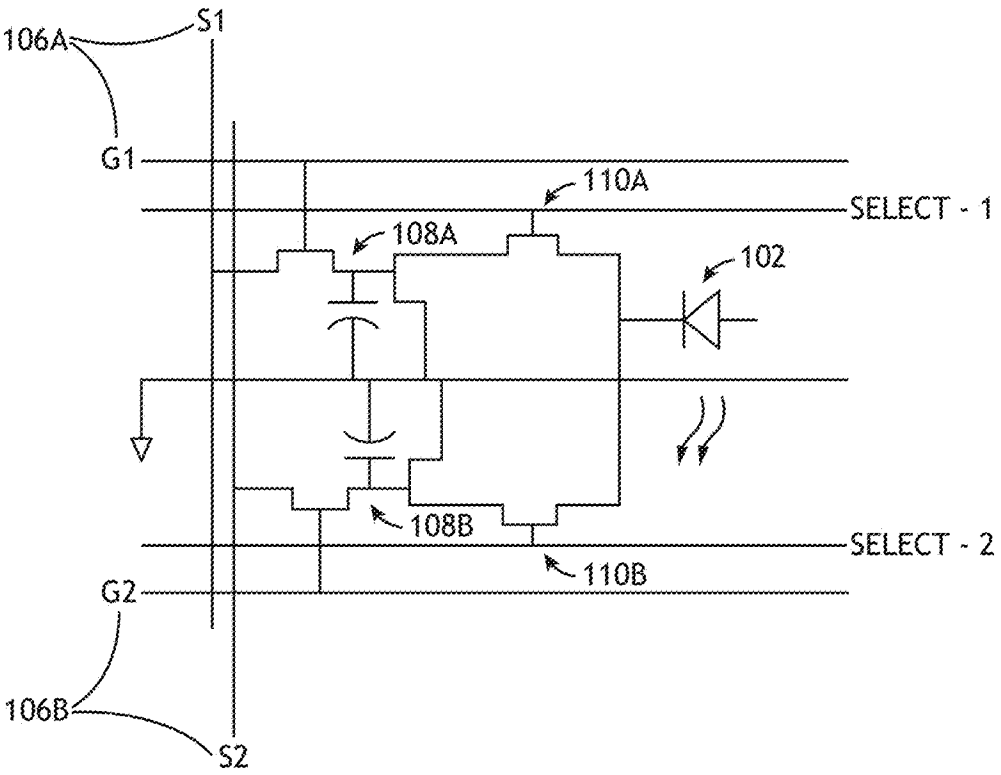
FIG. 2 is a simplified circuit diagram depicting a portion of a control circuit according to an exemplary embodiment of the inventive concepts disclosed herein.

It is also contemplated that additional transistors and/or other switching devices may be utilized to further enhance isolation between the two sets of control circuits. FIG. 2 is a simplified circuit diagram depicting two sets of drive circuits 108A and 108B, along with two additional switching devices 110A and 110B, jointly utilized to control a single light-emitting element 102. It is to be understood that while only a single light-emitting element 102 is shown in FIG. 2 for illustrative purposes, other light-emitting elements 102 across a portion (or the entire) display panel 104 may be controlled in the same manner as depicted in FIG. 2.

More specifically, as shown in FIG. 2, the switching device 110A may be activated/deactivated in response to a signal SELECT-1, which may be distributed (e.g., by the controller 120 shown in FIG. 1) to each switching device 110A associated with each light-emitting element 102 across the entire display panel 104. Similarly, the switching device 110B may be activated/deactivated in response to a signal SELECT-2, which may be distributed (e.g., by the controller 120) to each switching device 110B associated with each light-emitting element 102 across the entire display panel 104. It is contemplated that the switching devices 110A and 110B may provide a higher degree of isolation from a potentially failed control circuit. For instance, if it is determined that the drive circuits 108A and the source and gate control line driver 106A should be disabled, the SELECT-1 signal may be utilized to switch off all switching devices 110A associated with all light-emitting elements 102 across the entire display panel 104, effectively disconnecting the drive circuits 108A and the source and gate control line driver 106A from the light-emitting elements 102 across the entire display panel 104. It is to be understood that the SELECT-2 signal may be utilized in a similar manner in case the drive circuits 108B and the source and gate control line driver 106B should be disabled. It is contemplated that the SELECT-1 and SELECT-2 signals may be controlled by the controller 120 as previously described, allowing the switching devices 110A and 110B to be switched on or off based on whether their corresponding control circuits 106A/108A and 106B/108B are enabled or disabled.

It is to be understood that while the display device 100 is shown to have two sets of control circuits 106A/108A and 106B/108B, additional sets of control circuits may be provided in similar manners without departing from the broad scope of the inventive concepts disclosed herein. Providing additional sets of control circuits helps to provide additional levels of redundancy. It is contemplated that the specific level of redundancy may be determined based on various factors, including cost, complexity, criticality, dimension, and/or other considerations.

Figure 3:
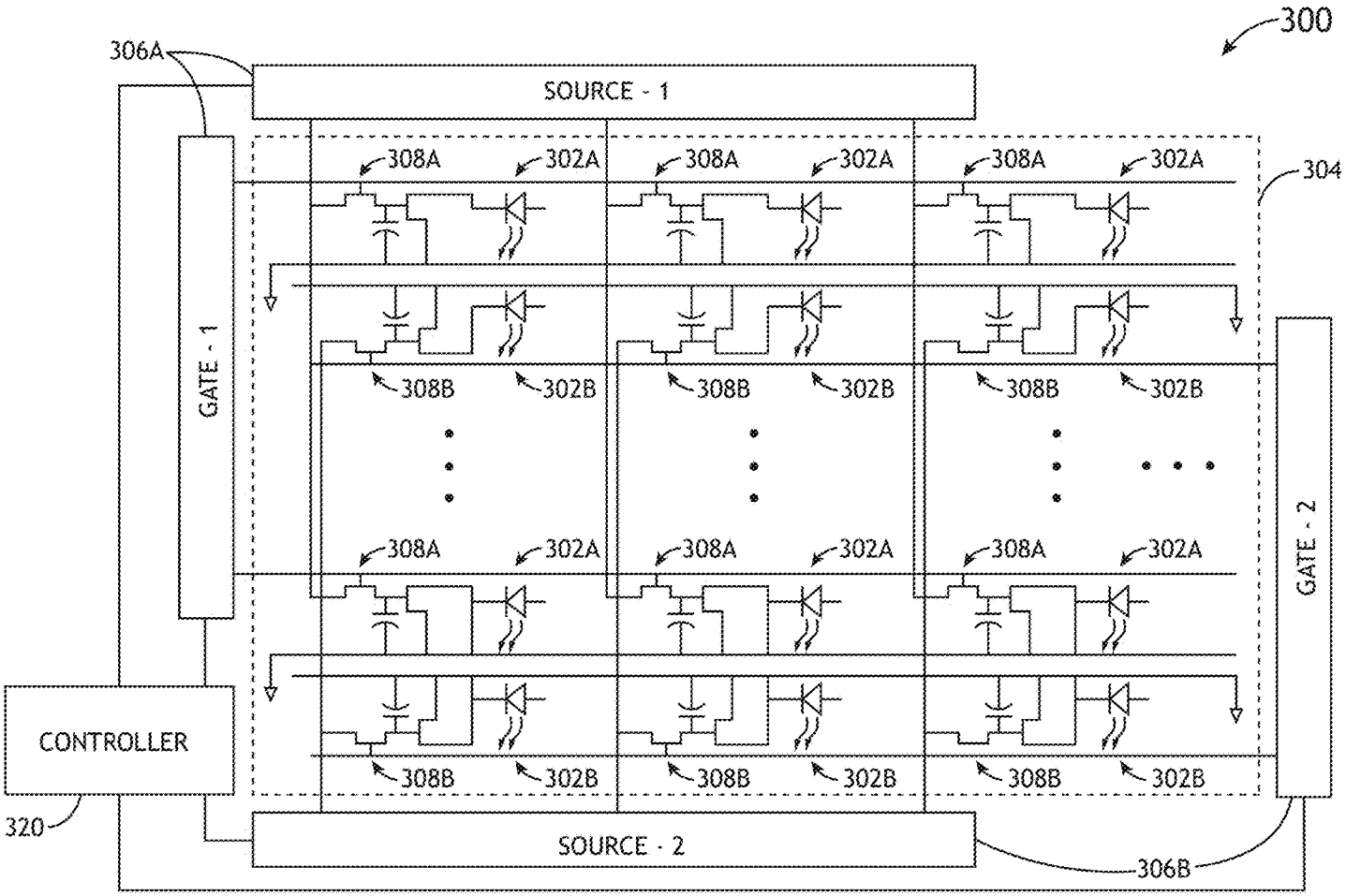
FIG. 3 is a simplified circuit diagram depicting another display device according to an exemplary embodiment of the inventive concepts disclosed herein.

It is further contemplated that in addition to providing redundant control circuits as described above, redundant light-emitting elements may also be provided in certain implementations to provide additional redundancy. FIG. 3 shows a simplified circuit diagram depicting an exemplary display device 300 that includes such redundant light-emitting elements. A display device 300 configured in this manner may be able to withstand control circuit failures as well as light-emitting element failures and still maintain its operations.

More specifically, as shown in FIG. 3, the display device 300 may include two sets of row- and/or column-interleaved light-emitting elements 302A and 302B. The display device 300 may also include two dedicated sets of drive circuits 308A and 308B separately controlled by their corresponding source and gate control line drivers 306A and 306B. The drive circuits 308A and 308B may be interleaved to correspond to the two sets of interleaved light-emitting elements 302A and 302B. It is noted that while separate ground signals may be connected to the two sets of drive circuits 308A and 308B as shown in FIG. 3 for illustrative purposes, the ground signals may be separated or connected (shared) without departing from the broad scope of the inventive concepts disclosed herein.

In certain implementations, each pair of adjacent light-emitting elements 302A and 302B may jointly operate as a logical light-emitting unit (e.g., logically forming a single pixel for display purposes), and both sets of light-emitting elements 302A and 302B may be driven by their corresponding control circuits 306A/308A and 306B/308B simultaneously. In this manner, if one light-emitting element (e.g., 302A) fails, the other light-emitting element (e.g., 302B) within the same pair may continue to operate without losing that pixel. In addition, if an entire set of light-emitting elements (e.g., all light-emitting elements 302A) were to fail, the display device 300 may still remain fully operational because the other set of light-emitting elements (e.g., light-emitting elements 302B) may still remain fully operational. Similarly, if one of the drive circuits (e.g., 308A) and/or one of the source and gate control line driver (e.g., 306A) were to fail partially or completely, the display device 300 may still maintain its operations because the remaining set of drive circuits (e.g., 308B) and source and gate control line driver (e.g., 306B) may continue to drive the light-emitting elements 302B to keep the display device 300 fully operational.

Alternatively, in certain implementations, adjacent light-emitting elements 302A and 302B are not required to operate as logical light-emitting units, but as individual pixels instead. Both sets of light-emitting elements 302A and 302B may still be engaged and driven by their corresponding control circuits 306A/308A and 306B/308B simultaneously, and if one set of light-emitting elements (e.g., 302A) fails, the remaining set of light-emitting elements (e.g., 302B) may continue to operate, but effectively providing a display panel that has a lower resolution (due to loss of pixels). It is noted that while the effective resolution may be lowered in such implementations, the display device 300 is nonetheless made fail-operational.

It is also noted that in either implementations, loss of light-emitting elements may lead to loss of perceived brightness of the display device 300. An optional implementation to compensate for this loss is to drive the remaining light-emitting elements at a higher level (to increase the perceived brightness). While this optional implementation may be desirable in certain situations, it is to be understood that whether to provide this optional implementation may be device specific and may vary without departing from the broad scope of the inventive concepts disclosed herein.

Alternatively, instead of simultaneously engaging both sets of light-emitting elements 302A and 302B, one of the sets 302A or 302B may be disengaged (e.g., turned off by the controller 320) to save power and may be automatically engaged in case of a failure detected in the other set. The controller 320 may also periodically switch between the two sets of light-emitting elements 302A and 302B to reduce operational fatigue. Further, it is to be understood that having two sets of light-emitting elements 302A and 302B may provide other advantages in addition to providing redundancy as described above. For instance, the controller 320 may use the two sets of light-emitting elements 302A and 302B to display separate display components during normal operations. That is, one of the sets (e.g., 302A) may be used to display lower intensity large area fill graphics items while the other set (e.g., 302B) may be used to display higher intensity vector graphics components. Such a configuration may be beneficial and may prevent higher intensity graphics from burning into the lower intensity regions. In the event of a failure, however, the separation between higher and lower intensity graphics may be disregarded and redundancy may be provided in manners previously described.

In another example, the two sets of light-emitting elements 302A and 302B may be configured to provide different levels of light-emitting configurations. For instance, one set of light-emitting elements (e.g., 302A) may include light-emitting elements that are larger and/or brighter than the other set of light-emitting elements (e.g., 302B). Such a configuration may allow the apparent brightness of various elements displayed on the display panel 304 to be adjustable by selectively activating one or both sets of light-emitting elements 302A and 302B. For example, the smaller emitters (e.g., 302B) may be used to display dim graphics elements, the larger emitters (e.g., 302A) may be used to display brighter elements, and both emitters (e.g., 302B and 302A) may be used together to display even brighter elements. It is to be understood that utilizing light-emitting elements of different levels of light-emitting configurations may also be utilized in conjunction with the optional implementation previously described to compensate for loss of perceived brightness, and may provide other advantages without departing from the broad scope of the inventive concepts disclosed herein.

It is to be understood that while the display device 300 is shown to have two sets of control circuits 306A/308A and 306B/308B and two sets of light-emitting elements 302A and 302B, additional sets of control circuits and light-emitting elements may be provided in similar manners without departing from the broad scope of the inventive concepts disclosed herein. Similarly, as previously mentioned, various techniques may be utilized to detect the failures that may occur, including utilization of external electrical monitoring circuitry, optical sensors, user monitoring and the like.

It is contemplated that the various implementations of redundant control circuits and/or redundant light-emitting elements described above may be scaled and adapted to fit various types of display devices of various sizes. The various implementations may also be combined without departing from the broad scope of the inventive concepts disclosed herein. It is also contemplated that an exemplary display device configured in accordance with the inventive concepts disclosed herein may be implemented on a rigid or a flexible substrate, which may range from substantially opaque to substantially transparent, depending on specific operational requirement of the display device. It is further contemplated that the light-emitting elements referenced above may utilize various types of light emitters, including LEDs, OLEDs, SEDs, as well as other types of emitters without departing from the broad scope of the inventive concepts disclosed herein.

It is further contemplated that while the examples depicted in the illustrations above referenced an N=2 redundancy, the level of redundancy (N) may be increased by providing additional redundant control circuits and/or redundant light-emitting elements without departing from the broad scope of the inventive concepts disclosed herein. It is to be understood that increasing the level of redundancy (N) may reduce the amount of display functionality lost under worst case failure conditions at the expense of increased complexity, and the specific choice of the level of redundancy (N) may be implementation specific and may vary without departing from the broad scope of the inventive concepts disclosed herein.

Furthermore, it is contemplated that interleaving of the redundant control circuits and/or redundant light-emitting elements may be implemented vertically and/or horizontally with respect to the orientation of the display panels shown in FIGS. 1 and 3. More specifically, the illustration depicted in FIG. 3 described an exemplary implementation having an interleaving factor i=1 both vertically and horizontally, meaning that every column and every row of the light-emitting elements are interleaved. It is contemplated, however, that the interleaving factor of i=1 is merely exemplary and may vary without departing from the broad scope of the inventive concepts disclosed herein. For example, an implementation that has a horizontal interleaving factor of i means that every i-number of columns of the light-emitting elements may be interleaved. It is contemplated that the interleaving factor may also be expressed as a ratio. For example, a horizontal interleaving factor of i=a:b means that a set of a-number of columns of the light-emitting elements may be interleaved with a set of b-number of columns of the light-emitting elements.

It is also contemplated that the interleaving factor i may be independently selected and may differ for the vertical and/or horizontal directions. For example, an implementation may have a vertical interleaving factor of i_v and a different horizontal interleaving factor of i_h. In another example, one of the vertical or horizontal directions may be implemented without interleaving, and it is noted that specific implementations may vary based on details of the desired redundancy requirements without departing from the broad scope of the inventive concepts disclosed herein.

It is to be understood that while aircraft display systems are referenced in the examples above, such references are merely exemplary. Display devices in accordance with the inventive concepts disclosed herein may be applicable to various types of displays, including displays mounted to vehicles (e.g., land, maritime, air, and space vehicles), portable displays (e.g., wearables, phones, head mounted, tablets, personal electronics, and the like), computer displays, television displays, as well as various other types of displays. It is also contemplated that in certain implementations, the display devices may be configured to support three-dimensional (3D) viewing; however, it is to be understood that 3D viewing capabilities are not required.

It is to be understood that embodiments of the inventive concepts described in the present disclosure are not limited to any underlying implementing technology. Embodiments of the inventive concepts of the present disclosure may be implemented utilizing any combination of software and hardware technology and by using a variety of technologies without departing from the broad scope of the inventive concepts or without sacrificing all of their material advantages.

It is believed that the inventive concepts disclosed herein and many of their attendant advantages will be understood by the foregoing description, and it will be apparent that various changes may be made in the form, construction, and arrangement of the components thereof without departing from the broad scope of the inventive concepts or without sacrificing all of their material advantages. The form herein before described being merely an explanatory embodiment thereof, it is the intention of the following claims to encompass and include such changes.

What is claimed is:

1. A display device, comprising:

a first set of light-emitting elements and a second set of light-emitting elements jointly forming a display panel, wherein the first set of light-emitting elements and the second set of light-emitting elements are interleaved across the display panel;

a first set of source and gate control line drivers coupled with the first set of light-emitting elements and configured to control the first set of light-emitting elements;

a second set of source and gate control line drivers coupled with the second set of light-emitting elements and configured to control the second set of light-emitting elements, the second set of source and gate control line drivers coupled with the second set of light-emitting elements being separate from the first set of source and gate control line drivers coupled with the first set of light-emitting elements; and a controller in communication with the first and the second sets of source and gate control line drivers, the controller configured to selectively enable or disable at least one of the first and the second sets of source and gate control line drivers, the controller configured to selectively enable and disable at least one of the first and the second sets of source and gate control line drivers for periods of time according to a predetermined schedule whereby one of the first and the second sets of light-emitting elements is periodically engaged according to the predetermined schedule, wherein the controller is further configured to simultaneously cause the first set of light emitting elements to display lower intensity graphics items while the second set of light emitting elements display higher intensity vector graphics components, wherein the controller is further configured to increase a brightness level of at least one of the first set of light-emitting elements or second set of light-emitting elements via at least one of the first or the second sets of source and gate control line drivers; and a user input which is activatable by a user when a failure within the at least one of the first or second set of source and gate control line drivers is detected by a user, wherein the failure information is communicated to the controller.

2. The display device of claim 1, wherein the first set of light-emitting elements and the second set of light-emitting elements are interleaved every i-number of columns or every i-number of rows across the display panel.

3. The display device of claim 1, wherein the controller is configured to disable at least one of the first or second set of source and gate control line drivers in response to a detected failure within the at least one of the first or second set of source and gate control line drivers.

4. The display device of claim 3, further comprising at least one image sensor or optical sensor configured to detect a failure within the at least one of the first or second set of source and gate control line drivers and upon detection of the failure, the least one image sensor or optical sensor configured to communicate the failure information to the controller.

5. The display device of claim 3, further comprising electrical monitoring circuitry to detect a failure within the at least one of the first or second set of source and gate control line drivers, the electrical monitoring circuitry configured to communicate the failure information to the controller.

6. The display device of claim 1, wherein the controller is configured to selectively and simultaneously enable the first set of source and gate control drivers and the second set of source and gate control drivers.

7. The display device of claim 1, wherein the controller is further configured to the first set of light emitting elements and the second set of light emitting elements to display separate display components.

8. The display device of claim 1, further comprising a substrate, the substrate being flexible or rigid.

* * * * *